US010465394B2

(12) United States Patent
Sighinolfi

(10) Patent No.: US 10,465,394 B2
(45) Date of Patent: Nov. 5, 2019

(54) TILE-LEVELLING SPACER DEVICE

(71) Applicant: RAIMONDI S.P.A., Modena (IT)

(72) Inventor: Riccardo Sighinolfi, Rubiera (IT)

(73) Assignee: RAIMONDI S.P.A., Modena (IT)

( * ) Notice: Subject to any disclaimer, the term of this patent is extended or adjusted under 35 U.S.C. 154(b) by 0 days.

(21) Appl. No.: 15/950,352

(22) Filed: Apr. 11, 2018

(65) Prior Publication Data

US 2018/0291640 A1 Oct. 11, 2018

(30) Foreign Application Priority Data

Apr. 11, 2017 (IT) ..... 202017000039807
Mar. 7, 2018 (IT) ..... 202018000002036

(51) Int. Cl.
*E04F 21/20* (2006.01)
*E04F 21/00* (2006.01)

(52) U.S. Cl.
CPC ..... *E04F 21/20* (2013.01); *E04F 21/0092* (2013.01)

(58) Field of Classification Search
CPC ... E04F 21/20; E04F 21/0092; E04F 21/1877; E04F 15/02022
USPC ..... 52/126.1, 126.5, 126.6, 384, 389, 385, 52/393, 396.04, 396.1, 747.11, 749.11, 52/742.16
See application file for complete search history.

(56) References Cited

U.S. PATENT DOCUMENTS 8,671,628 B2 * 3/2014 Sighinolfi ..... E04F 15/02022 33/527
8,800,246 B2 * 8/2014 Gorton ..... E04F 21/0092 52/747.11
8,887,475 B2 * 11/2014 Ghelfi ..... E04F 21/0092 52/749.11
9,447,590 B2 * 9/2016 Sighinolfi ..... E04F 21/18
9,534,403 B2 * 1/2017 Biec ..... E04F 21/0092
9,970,203 B1 * 5/2018 Abidov ..... E04F 21/0092
(Continued)

FOREIGN PATENT DOCUMENTS

EP 2966239 A1 * 1/2016
GB 2538545 A * 11/2016
WO WO-2015161366 A1 * 10/2015 ..... E04F 21/0092

*Primary Examiner* — Brent W Herring
(74) *Attorney, Agent, or Firm* — Browdy and Neimark, pLLC

(57) ABSTRACT

A tile-leveling spacer device comprising:

a base having a lower surface and an opposite upper surface, wherein the upper surface comprises two opposite side portions with respect to a central portion and each defining a planar surface arranged at a second distance from the lower surface, wherein the second distance is less than the first distance;

a spacer bridge defining with the base a through opening adapted for being crossed by a pressing wedge, wherein:

each leg of the bridge is connected to the base at a respective side portion of the base in a breakable manner through a predetermined fracture line arranged at a third distance from the intermediate lower surface with respect to the first distance and to the second distance, each side portion has a longitudinal axis parallel to the crossing direction of the pressing wedge and extends for the entire length of the base along such a crossing direction, and the second distance is comprised between 20% and 90% of the first distance.

14 Claims, 7 Drawing Sheets

(56) References Cited

U.S. PATENT DOCUMENTS

| | | | | |
|---|---|---|---|---|
| 2013/0055675 | A1* | 3/2013 | Sighinolfi | E04F 21/0092 52/749.11 |
| 2014/0033640 | A1* | 2/2014 | Gorton | E04F 21/22 52/747.11 |
| 2014/0116001 | A1* | 5/2014 | Ghelfi | E04F 21/0092 52/749.11 |
| 2015/0308130 | A1* | 10/2015 | Biec | E04F 21/0092 52/749.11 |
| 2016/0090746 | A1* | 3/2016 | Sighinolfi | E04F 21/18 33/526 |

* cited by examiner

TILE-LEVELLING SPACER DEVICE

TECHNICAL FIELD

The present invention concerns a leveling spacer device for applying sheet-like manufactured products, such as tiles, slabs of natural stone or similar, for coating surfaces, such as walking surfaces, floors, wall or ceiling coatings and similar.

PRIOR ART

In the field of the application of tiles for coating surfaces, such as floors, walls and similar, it is known to use spacer devices that, as well as evenly spacing the adjacent tiles, allow the planar arrangement thereof, such devices being commonly called leveling spacer devices.

Known leveling spacer devices generally comprise a base, able to be positioned below the application surface of at least two adjacent tiles, from which at least one spacer bridge rises up, adapted for contacting, through its side flanks, the facing sidewalls of the two tiles to be arranged close together on the application surface.

The leveling spacer device is also equipped with a pressing wedge adapted for wedging between a cross-member of the spacer bridge and the visible surface of the tiles resting on the base, so as to press the visible surfaces of the tiles towards the base, leveling them.

The bridge is then removed through separation from the base after the solidification of the tile glue leaving the base hidden beneath the surface of application of the tiles themselves incorporated in the solidified glue.

In these leveling spacer devices there is a great need to reduce as much as possible the volume taken by the glue from the portion of leveling spacer device that remains incorporated in it after breaking, in particular in the gap area (channel) defined between the two tiles separated by the separating bridge.

A further great need is to reduce as much as possible the areas of the tile that are not in direct contact with the glue, so as to allow an excellent adhesion of the tile to the surface to be coated through the glue itself.

Furthermore, in these leveling spacer devices there is a great need to make the separation of the bridge from the base particularly efficient and simple once the glue has set and, at the same time, to make the area intended to cause the separation between the bridge and the base sufficiently strong and resilient, so as to avoid or limit the risk of accidental separations between the bridge and the base or during the transportation or storage of the leveling spacer devices or during the use thereof before the desired moment.

A purpose of the present invention is to satisfy the aforementioned requirements of the prior art, in a simple, rational and low-cost solution.

Such purposes are accomplished by the characteristics of the invention given in the independent claim. The dependent claims outline preferred and/or particularly advantageous aspects of the invention.

PRESENTATION OF THE INVENTION

The invention, particularly, provides a tile-leveling spacer device comprising:

- a base having a lower surface and an opposite upper surface, wherein the upper surface comprises:
  - a central portion defining a support plane for two adjacent tiles arranged at a first distance from the lower surface and

- two opposite side portions with respect to the central portion and each defining a planar surface arranged at a second distance from the lower surface,
  - wherein the second distance is less than the first distance;
- a spacer bridge equipped with:
  - two legs rising from the base in a direction perpendicular to at least the central portion of the upper surface of the base and
  - a cross-member that joins the top of the two legs and is arranged parallel to and distanced from the upper surface of the base;
- a through opening delimited perimetrically by the cross-member and the legs of the bridge and by the upper surface of the base, wherein the through opening is suitable for being crossed by a pressing wedge along a crossing direction;
  - wherein each leg of the bridge is connected to the base at a respective side portion of the base in a breakable manner through a predetermined fracture line arranged at a third distance from the intermediate lower surface with respect to the first distance and to the second distance,
  - wherein each side portion has a longitudinal axis parallel to the crossing direction of the pressing wedge and extends for the entire length of the base along such a crossing direction, and
  - wherein the second distance is comprised between 20% and 90% of the first distance.

Thanks to such a solution, each side portion defines a lowered area of the base in which the glue can penetrate and improve the hold of the tile, decreasing the contact surface between tile and base of the device.

Moreover, since the fracture line is arranged in this lowered area beneath the support plane of the tiles, none of the base, once the bridge is removed, is above the surface of application of the tiles, not even the gap (channel) between the tiles.

Advantageously, the second distance can be comprised between 20% and 80%, preferably between 48% and 58% of the first distance.

Alternatively, even more advantageously, the second distance can be comprised between 81% and 90% of the first distance, preferably equal to 88% of the first distance.

Thanks to such a solution, a good compromise between the stability of the base (the strength of the leveling spacer device), i.e. its constant function with respect to the bridge, and the function of a lowered area adapted for receiving the fracture line beneath the support plane of the tiles.

A further aspect of the invention foresees that the upper surface can comprise a pair of opposite inclined surfaces at the ends of the base distal from the bridge and opposite with respect to it, wherein each inclined surface defines a ramp rising from the end of the base towards the bridge, in a direction parallel to the crossing direction, and which connects the lower surface of the base to the support plane of the central portion of the base.

Thanks to such a configuration of the base, together with the shape of the lowered side portions of the base itself, the insertion action of the bases beneath the tiles is made easier with a translation parallel to the crossing direction of the wedge.

Advantageously, the base can comprise a pair of opposite through slots from the lower surface to the upper surface at the central portion thereof, wherein the slots are open laterally at the respective ends of the base distal from the bridge and opposite with respect to it.

Thanks to such a solution, the volume of glue that holds the surface of application of the tile at the base is accentuated even further.

For example, each slot can be adapted for intersecting a respective inclined surface, dividing it into two separate portions along a direction perpendicular to the crossing direction.

Such a characteristic is even more important when the base is arranged at a joining line of four tiles.

According to an aspect of the invention, the fracture line can be defined by a longitudinal notch defining the area having a smaller section of the entire leg, wherein the longitudinal notch is parallel to the planar surface of the respective side portion of the upper surface of the base and perpendicular to the crossing direction, and wherein the longitudinal notch has a cross-section having a concave shape rounded according to a first radius of curvature.

Thanks to such a solution, the stress concentration to start the breaking between the bridge and the base is optimised.

In particular, the fracture line has been studied so as to allow a high resistance to breaking, i.e. a high resilience, when the bridge undergoes flexing stress with respect to a flexing axis parallel to the mid-plane of the bridge (that cuts through both of the legs and the cross-member thereof), but at the same time a high fragility, i.e. an efficient fracture-starting notch, if stressed through an impulsive traction force (axial).

In particular, all the time that the device does not have to be broken, i.e. in the transportation, storage and manipulation steps and in the first application operations thereof, such a fracture line and the leg as a whole is such as to dissipate possible deformations and react elastically to the deformations (for example allowing the rotation of the leg with respect to an imaginary hinge axis parallel to or coinciding with the fracture line, when the device has to be broken, at the end of the application operations, on the other hand, through an impulsive impact, for example through a kick, directed at the top of the bridge and in a direction parallel to such a hinge line (such as to cause an axial impulsive traction stress on the leg), the fracture line will effectively trigger the separation between the leg and the base along the desired separation plane.

Moreover, the fracture line thus studied is such as to ensure a sufficient resistance to the axial traction in non-impulsive conditions, like in the use of the pressing wedge during the step of use of the device.

Preferably, from the same point of view described above, the longitudinal notch can be joined to the portion of the leg above it through a joining surface rounded according to a second radius of curvature, opposite and greater with respect to the first radius of curvature.

Advantageously, each leg can comprise a central sector arranged between the cross-member and the lower end of the leg, wherein the central sector is equipped with two opposite flanks with respect to the crossing direction and parallel to one another, said flanks being adapted for making contact with the adjacent tiles resting on the central portion of the upper surface of the base defining their distance apart, the central sector being connected to the respective side portion of the upper surface of the base by means of a block having a smaller cross-section than the distance between the two flanks of the central sector, wherein the upper end of the block is arranged at a fourth distance from the lower surface of the base that is greater than the first distance.

Thanks to such a solution, the tapered block is such as to dissipate possible quick deformations. In practice, if the bridge is bent quickly there is the risk of the plastic from which it is made having a non-elastic behaviour, the bridge thus configured is such as to distribute the deformation and, therefore, slow down the deformation of the fracture line that must be kept as intact as possible until the fracture must be deliberately triggered.

Advantageously, the upper end of the block can be joined to the central sector of the leg through a joining surface rounded according to a third radius of curvature, the same way as and greater than the first radius of curvature.

A further aspect of the invention foresees that the upper surface (and/or the bridge) of the base can have a surface roughness comprised between 20VDI-30VDI.

Thanks to such a solution, the hold of the laying glue to the base (and/or the grip of the person tasked with application on the bridge) is improved.

A further aspect of the invention provides a tile-leveling spacer device comprising:

- a base having a lower surface and an opposite upper surface defining a support plane for two adjacent tiles;
- a spacer bridge equipped with:
  - two legs rising from the base, wherein each leg of the bridge is connected to the base in a breakable manner through a predetermined fracture line, and
  - a cross-member that joins the top of the two legs and is arranged parallel to and distanced from the upper surface of the base;
- a through opening delimited perimetrically by the cross-member and the legs of the bridge and by the upper surface of the base, wherein the through opening is suitable for being crossed by a pressing wedge along a crossing direction;

wherein the fracture line is defined by a longitudinal notch defining the area having a smaller section than the entire leg, and wherein the notch has a cross-section with respect to a plane parallel to the crossing direction having a concave shape rounded according to a first radius of curvature.

BRIEF DESCRIPTION OF THE DRAWINGS

Further characteristics and advantages of the invention will become clear from reading the following description provided as an example and not for limiting purposes, with the help of the figures illustrated in the attached tables.

BEST EMBODIMENT OF THE INVENTION

Figure 1:
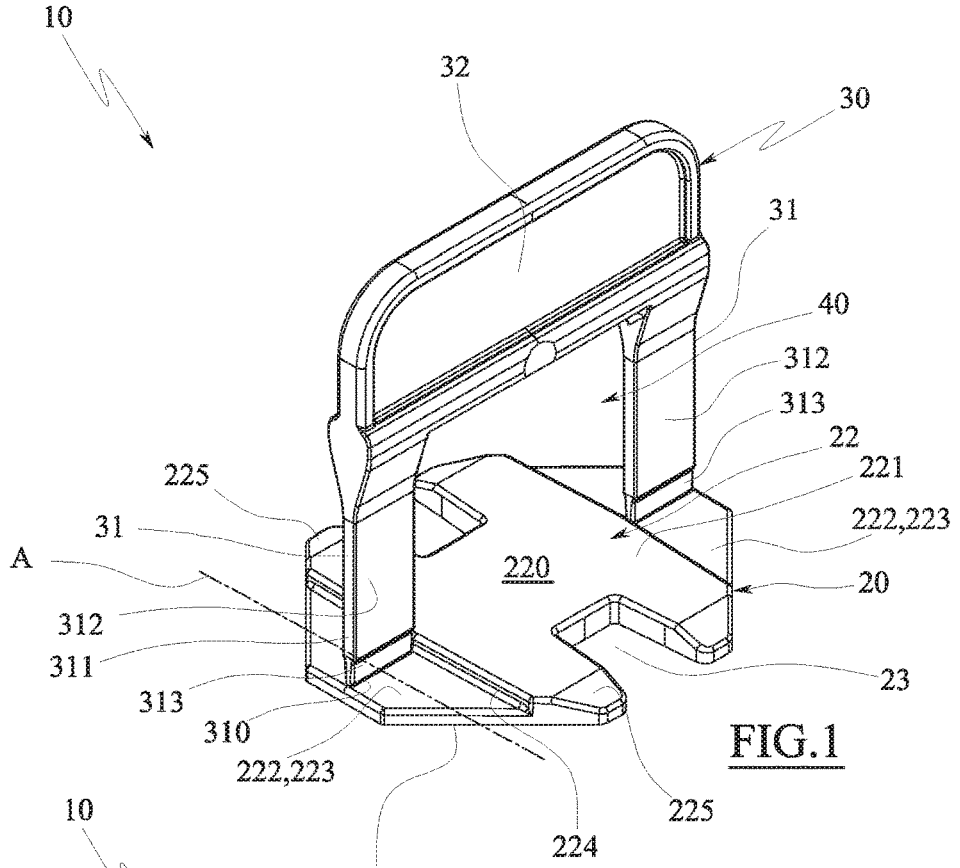
FIG. 1 is an axonometric view of a first embodiment of a leveling spacer device, according to the invention.
Figure 2:
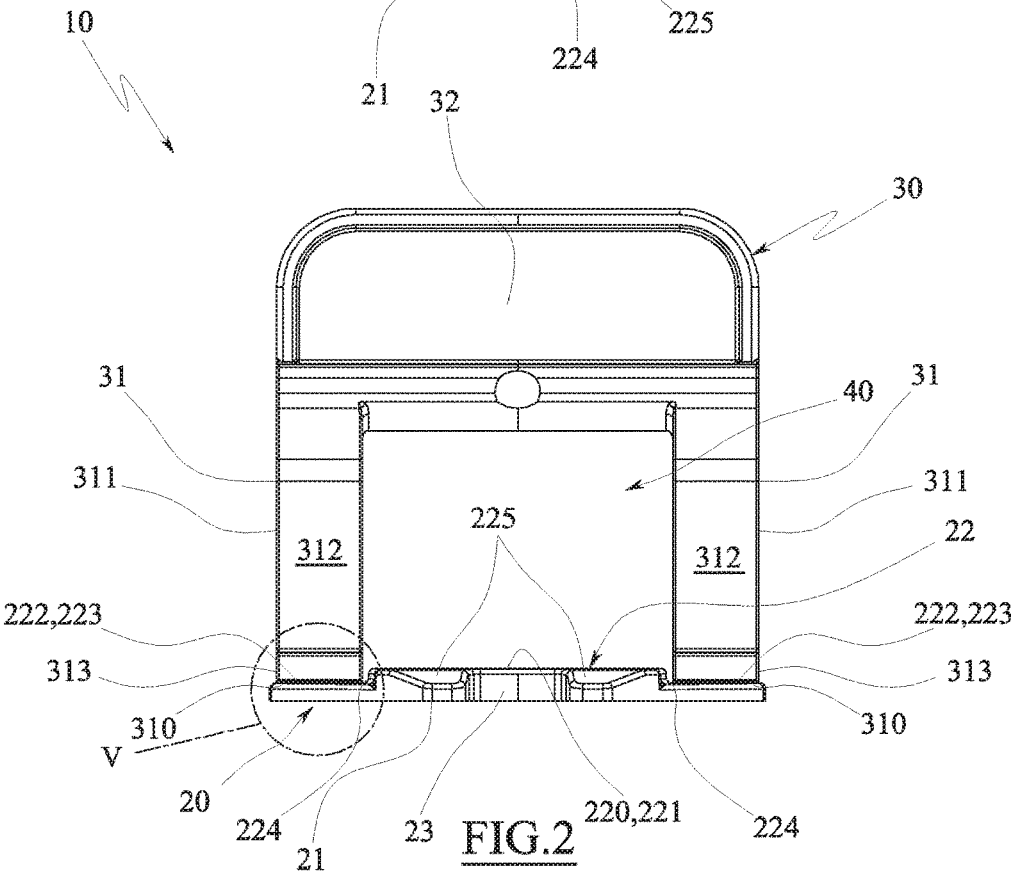
FIG. 2 is a front view of FIG. 1.
Figure 3:
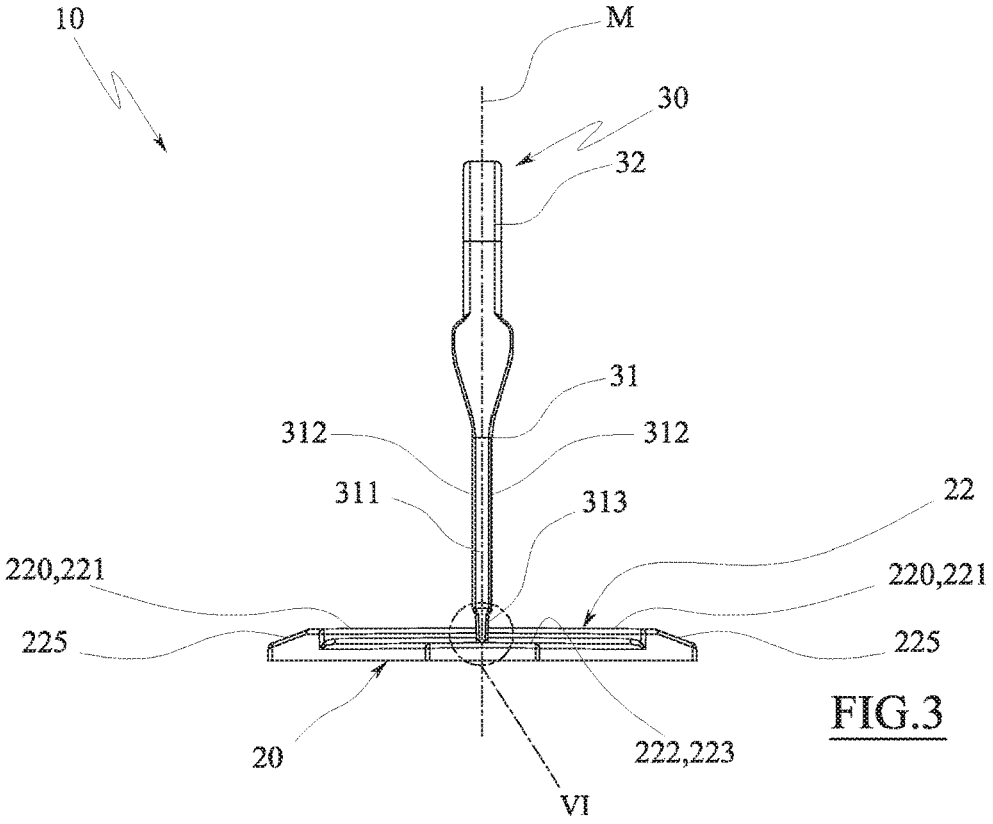
FIG. 3 is a side view of FIG. 1.
Figure 4:
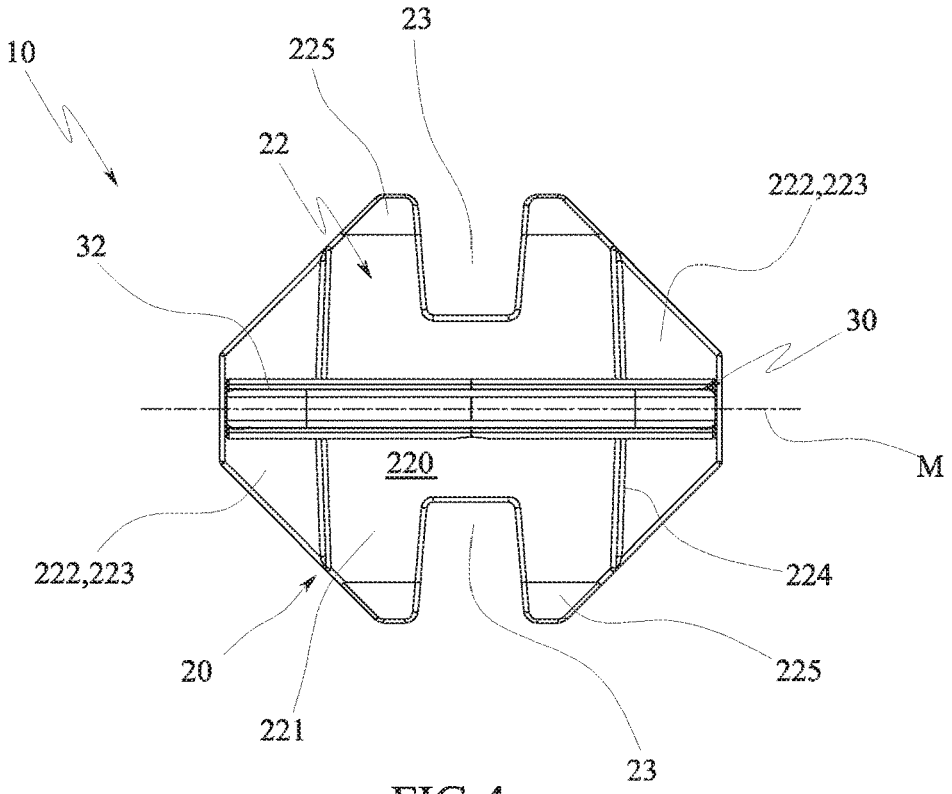
FIG. 4 is a plan view from above of FIG. 1.

With particular reference to such figures, reference numeral 10 globally indicates a leveling spacer device adapted for facilitating the application of sheet-like manufactured products, such as tiles and similar, globally indicated with the letter P, and adapted for coating surfaces, i.e. floors, walls, ceilings and similar.

The device 10 comprises a base 20 of widened shape, for example polygonal.

The base 20, in the example depicted, is a monolithic body that has an irregular shape (in plan), for example substantially octagonal.

The base 20 comprises a lower surface 21, for example flat.

The lower surface 21 is adapted for being rested on a layer of glue arranged on the block that is intended to be coated by the tiles P.

The base 20 also comprises an upper surface wholly indicated with reference numeral 22.

The upper surface 22 comprises a central portion 220 defining a support plane 221 for two adjacent tiles P.

The support plane 221, i.e. the higher flat surface of the upper surface 22 that defines the central portion 220, is arranged at a first distance d1 from the lower surface 21.

The support plane 221 is the surface of the base 20 furthest from the lower surface 21.

In practice, the maximum thickness of the base 20 is defined by the first distance d1.

The support plane 221 is a plane substantially parallel to the lower surface 21 (planar).

The upper surface 22 of the base 20 also comprises two mutually opposite side portions 222 with respect to the central portion 220, for example symmetrical (and the same) with respect to a mid-plane M of the base 20 perpendicular to the support plane 221 and cutting through the central portion 220 and the side portions 222.

Each side portion 222 defines a planar surface 223 arranged at a second distance d2 from the lower surface 21, wherein the second distance d2 is less than the first distance d1.

In practice, the thickness of each side portion 222 of the base 20 is defined by the second distance d2 and is less than the thickness of the central portion 221 of the base itself.

For example, the second distance d2 is comprised between 20% and 90%.

In a possible embodiment of the base 20, the second distance d2 is comprised between 20% and 80%, preferably between 48% and 58%, of the first distance d1.

In such a case, for example, the first distance d1 can be comprised between 2.55 mm and 2.7 mm and the second distance d2 can be comprised between 1.15 mm and 1.35 mm.

In a preferred (and alternative) embodiment of the base 20, the second distance d2 is comprised between 81% and 90%, preferably equal to 88%, of the first distance d1.

In such a case, for example, the first distance d1 can be comprised between 2.4 mm and 2.5 mm, preferably equal to 2.48 mm and the second distance d2 can be comprised between 2.1 mm and 2.2 mm, preferably equal to 2.18 mm.

Each side surface 223 is a plane substantially parallel to the lower surface 21 (planar) and to the support plane 221 (distinct from them).

The upper surface 22 comprises a joining surface 224 arranged between each planar surface 223 and the support plane 221.

The joining surface 224 is substantially perpendicular to the planar surface 223 and to the support plane 221, defining the rise of one step between them.

Each side portion 222 of the upper surface 22, i.e. each planar surface 223, has a longitudinal extension, i.e. it has a main direction of extension, along a longitudinal axis A, which is perpendicular to the mid-plane M of the base 20 that cuts through the central portion 220 and the side portions 222.

In practice, each planar surface 223 defines an elongated strip (having a length greater than the width) with longitudinal axis A perpendicular to the aforementioned mid-plane M of the base 20 and arranged at a lower level with respect to the level defined by the support plane 221 defined by the central portion 220 of the base 20.

The planar surface 223 has a substantially trapezoidal shape in plan, for example shaped like an isosceles trapezium, wherein the larger base is proximal to the support plane 221, i.e. it is joined to it through the joining surface 224, and the smaller base, opposite to it, defines the (free) side end distal from the central portion 220 of the base 20.

The upper surface 22 of the base 20 comprises a pair of opposite inclined surfaces 225 with respect to the mid-plane M of the base 20 that cuts through the central portion 220 and the side portions 222.

Each inclined surface 225 defines a ramp rising from the end of the base 20 towards the aforementioned mid-plane M in a direction perpendicular to the mid-plane M and that connects the lower surface 21 of the base 20 to the support plane 221 of the central portion 220 of the base 20.

Each inclined surface 225 has a maximum distance from the lower surface 21 equal to the first distance d1 and a minimum distance from the lower surface 21 comprised between zero and the second distance d2, preferably equal to the distance d2.

Each inclined surface 225 lies on a plane inclined by an acute (inner) angle with respect to the lower surface 21.

The base 20 comprises a pair of opposite slots 23 passing from the lower surface 21 to the upper surface 22, which are arranged at the central portion 220 of the upper surface 22.

Each slot 23 has an elongated shape, i.e. it has a main direction of extension, along a longitudinal axis perpendicular to the mid-plane M of the base 20 that cuts through the central portion 220 and the side portions 222.

In practice, each slot 23 has a longitudinal axis parallel to the longitudinal axis A of the side portions 221 of the upper surface 22 of the base 20.

Each slot 23 is laterally open at a respective end of the base 20 distal from the mid-plane M.

Each slot 23 defines a longitudinal through crack of the base 20 from the end distal from the mid-plane M towards it and with main direction perpendicular to it.

The length of each slot 23 is less than half the length of the base 20 in the direction perpendicular to the mid-plane M, for example it is comprised between 0.4 times and 0.55 times half of the length of the base 20 in the direction perpendicular to the mid-plane M, for example 0.54 times half of the length of the base 20 in the direction perpendicular to the mid-plane M.

For example, each slot 23 is adapted to intersect a respective inclined surface 225 dividing it into two separate portions along a direction parallel to the mid-plane M and to the lower surface 21.

The base 20, in particular the upper surface 22 thereof (with the exception of the inclined surfaces 225), has a surface roughness substantially comprised between 20VDI-30VDI.

The device 10 comprises a spacer bridge 30, which is adapted, in use, for contacting at least one portion of the adjacent flanks of the at least two tiles P resting on the support plane 221 of the upper surface 22 of the base 20.

The bridge 30 comprises two legs 31 each rising from a side portion 222 of the upper surface 22 of the base 20 in a direction perpendicular to at least the central portion 220 of the upper surface 22 of the base itself.

The bridge 31 also comprises a cross-member 32 that joins the top of the two legs 31 and is arranged with longitudinal axis parallel to and distanced from the upper surface 22 of the base 20.

The bridge 30 is for example made in a single body with the base 20, for example through injection moulding of plastic material.

The bridge 30 is globally defined by a plate-like body arranged parallel to the mid-plane M of the base 20, so that the mid-plane M of the base 20 is also a mid-plane of the bridge 30 itself.

Each leg 31 of the bridge 30 has a lower end fixed to the planar surface 223 of the respective side portion 222.

Each leg 31 of the bridge 30 is connected to the planar surface 223 of the respective side portion 222 of the base 20 in a breakable manner through a predetermined fracture line 310.

Figure 5:
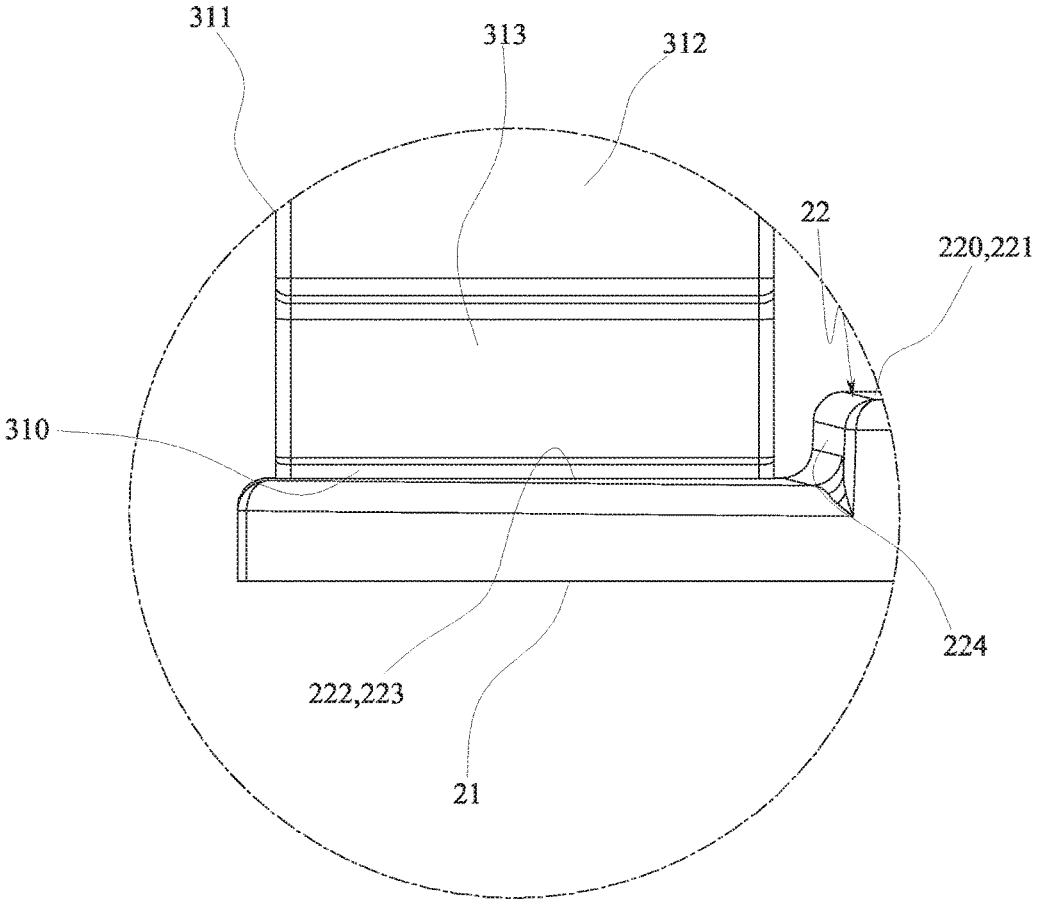
FIG. 5 is an enlargement of the detail V of FIG. 2.
Figure 6:
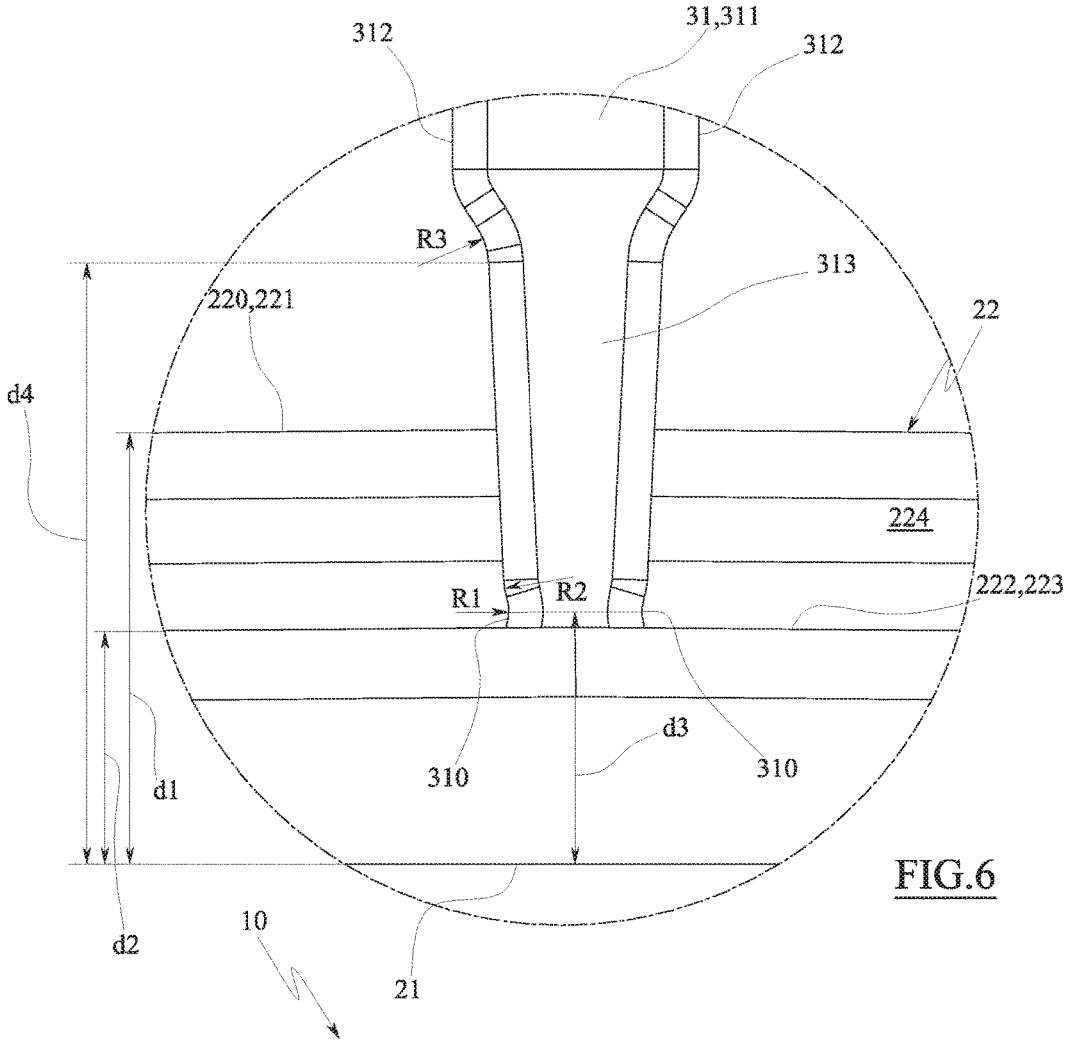
FIG. 6 is an enlargement of the detail VI of FIG. 3.

The fracture line 310, visible in the details of FIGS. 5 and 6, is parallel to the planar surface 223 (and to the mid-plane M) and is arranged at a third distance d3 from the intermediate lower surface with respect to (comprised between) the first distance d1 and to the second distance d2.

For example, the third distance d3 is closer to the second distance d2 than to the first distance d1.

The third distance d3 is substantially equal to or slightly greater than the second distance d2.

Each leg 31 of the bridge 30 is substantially sheet-like and has a longitudinal axis (main direction) perpendicular to the planar surface 223 of the side portion 222 from which it branches.

Each leg 31 has a height (in a direction parallel to its longitudinal axis) that is greater than the thickness of the tiles P to be arranged at adjacent to one another, so that the cross-member 32 of the bridge 30 is always at a greater level (distance from the lower surface 21) than the level of the visible surface of the tiles P to be arranged at adjacent to one another.

Figure 7:
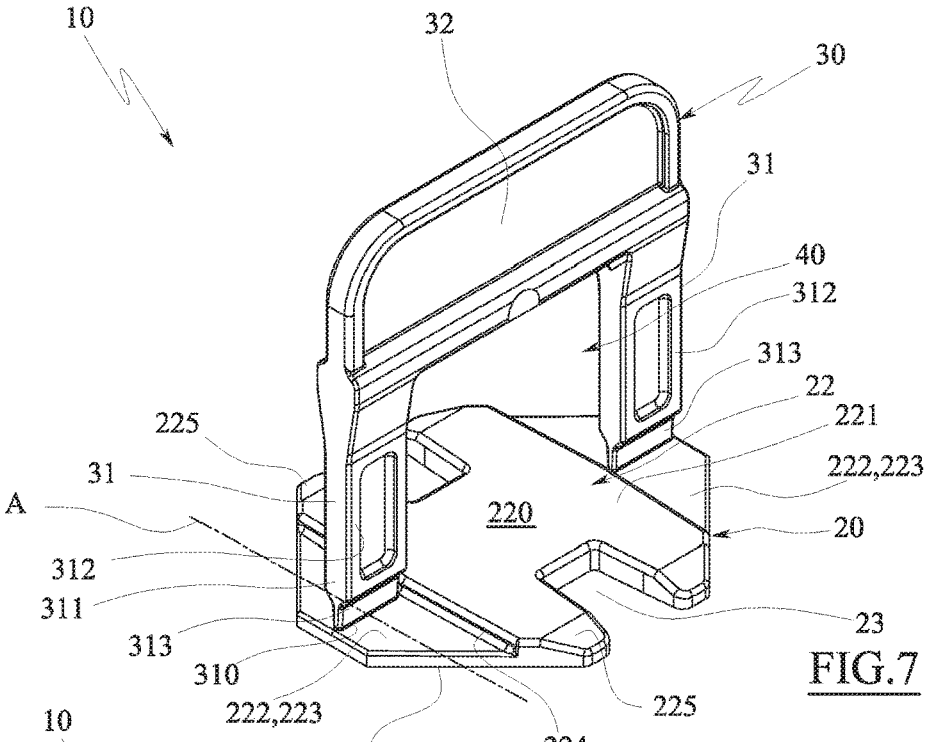
FIG. 7 is an axonometric view of a second embodiment of a leveling spacer device, according to the invention.
Figure 8:
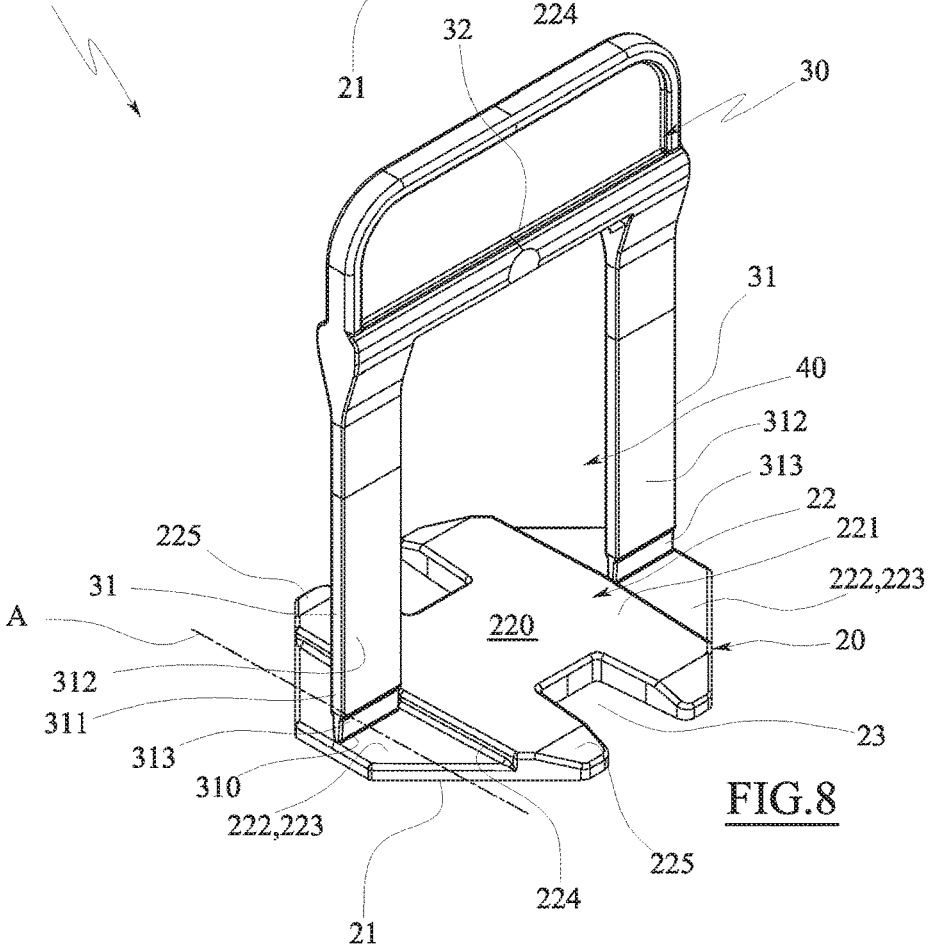
FIG. 8 is an axonometric view of a third embodiment of a leveling spacer device, according to the invention.

The device 10 can be of the type shown in FIG. 1-4 or 7, characterised by a low height of the legs, or of the type shown in FIG. 8, characterised by a greater height of the legs 31, in relation to the format of tiles P to be applied.

Each leg 31 has a width, by width meaning the dimension parallel to the mid-plane M (that cuts through both of the legs 31 and the cross-member 32 of the bridge 30), smaller than the width of the planar surface 223 of the respective side portion 222.

In practice, each leg 31 (i.e. its edge facing towards the other leg 31) has a (non-zero) distance from the joining surface 224 of the upper surface 22 of the base 20, i.e. between each leg 31 and the joining surface 224 a gap is defined.

Each leg 31 has a variable thickness (for example in sections) along the longitudinal axis thereof.

The term thickness of the leg 31 is meant to indicate the dimension of the leg 31 in the direction perpendicular to the mid-plane M of the bridge 30 that cuts through both of the legs 31 and the cross-member 32 of the bridge 30.

Each leg 31 comprises a central sector 311 arranged at axially between the cross-member 32 and the lower end of the leg 31, wherein the central sector 311 is equipped with two opposite flanks 312 with respect to the mid-plane M and parallel to one another.

The flanks 312 of the central sector 311 are the area of the leg 31 that comes into contact with the adjacent tiles P resting on the central portion 221 of the upper surface 22 of the base 20 defining their distance apart in a direction perpendicular to the mid-plane M.

The distance between the flanks 312 defines the width of the channel (inter-space) between the tiles P.

The device 10 can be of the type shown in FIG. 1-4 or 8, characterised by a low distance between the flanks 312, or of the type shown in FIG. 7, characterised by a greater distance between the flanks 312, in relation to the format of tiles P to be applied.

In this last case, as illustrated in FIG. 8, at the flanks 312 there can be weight-reducing hollows or recesses (blind or passing right through).

Each leg 31 also comprises a block 313 adapted for interconnecting the central sector 311 with the planar surface 223 of the respective side portion 221 of the base 20.

The block 313 has a thickness, i.e. a cross-section carried out with respect to a plane perpendicular to the mid-plane M, smaller than the distance between the two flanks 312 of the central sector 311.

The block 313 has an upper end connected to the central sector 311 and a lower end, which coincides with the lower end of the leg 31 as a whole, connected directly to the planar surface 223 of the respective side portion 222 of the base 20. The fracture line 310 is defined at the block 313, in an area proximal to the lower end thereof.

The fracture line 310, as shown in the detail of FIG. 6, is defined by a longitudinal notch defining the area having the smaller cross-section (in whichever direction and in particular in the direction perpendicular to the mid-plane M) than the entire leg 31.

The longitudinal notch that defines the fracture line 310 defines the fracture-starting area of the bridge 30 with respect to the base 20.

The longitudinal notch has a longitudinal axis parallel to the planar surface 223 of the respective side portion 222 and to the mid-plane M and is fully developed, i.e. it occupies the entire width of the leg 31 (i.e. of the block 313).

The longitudinal notch has a constant cross-section (i.e. with respect to a plane perpendicular to the mid-plane M) along the entire length thereof and having a concave shape rounded according to a first radius of curvature R1.

In practice, the shape of the longitudinal notch is substantially semi-cylindrical.

The first radius of curvature R1 is substantially comprised between 0.4 and 0.2 mm, preferably equal to 0.3 mm.

The depth along the thickness of the block 313 of the longitudinal notch is substantially comprised between 0.01 mm and 0.02 mm.

Each leg 31, i.e. each block 313, comprises a pair of identical fracture lines 310, i.e. of longitudinal notches, symmetrically arranged with respect to the mid-plane M of the bridge 30 (and of the base 20).

In practice, the minimum section of the leg 31, that starts the fracture of the bridge 30) is defined at the joining plane of the minimums of the concave shape rounded according to a first radius of curvature R1 defining the two longitudinal notches.

Advantageously, each longitudinal notch is joined to the portion of the leg 31 (i.e. of the block 313) above it through a joining surface rounded according to a secondo radius of curvature R2, opposite and greater with respect to the first radius of curvature R1 (for example comprised between 0.3 mm and 0.5 mm, preferably equal to 0.4 mm).

The upper end of the block 313, i.e. the area in which the block 313 joins with the central sector 311, is arranged at a fourth distance d4 with respect to the lower surface 21 of the base 20, said fourth distance d4 being greater than the first distance d1.

In practice, the upper end of the block 313 projects above the level defined by the support plane 211 of the central portion 210 of the upper surface 22 of the base 20.

For example, the fourth distance d4 is substantially equal to the sum of the first distance d1 and the second distance d2.

The upper end of the block 313 is joined to the central sector 311 of the leg 31 through a joining surface rounded according to a third radius of curvature R3, which is the same way as and greater with respect to the first radius of curvature R1 (for example equal to the second radius of curvature R2), and/or by inclined V-shaped walls.

The cross-member 32 comprises a cross-section (with respect to a plane perpendicular to the mid-plane M) defining an area with greater thickness in an area proximal to the upper end of the legs 31 and with full longitudinal extension. Such an area with greater thickness defines a reinforcing beam for the bridge 30. Such an area with greater thickness has a thinner grip portion on top of it and joins to the legs 31 through inclined joining surfaces.

The reinforcing beam, in the area arranged between the legs 31, i.e. juxtaposed over the central portion 220 of the upper surface 22 of the base 20, ends at the bottom with a shaped edge, for example V-shaped.

The distance of the shaped edge from the central portion 220 of the upper surface 22 of the base 20 is (much) greater than the thickness of the tiles P to be applied.

The bridge 30, with its portal shape described above, and the base 20 joined to it delimit a through opening 40 that passes through the bridge 30 and the base 20 in a direction perpendicular to the mid-plane M thereof.

The through opening 40 is delimited perimetrically by the cross-member 32 and the legs 31 of the bridge 30 and by the upper surface 22 of the base 20.

In greater detail, the through opening 40 is delimited on top by the shaped edge of the reinforcing beam of the cross-member 32, at the bottom (almost totally) by the support plane 221 of the central portion 220 of the upper surface 22 of the base (i.e. the area thereof under the cross-member 32) and laterally by the facing edges of the legs 31.

The through opening 40 has an overall substantially rectangular shape.

Figure 9:
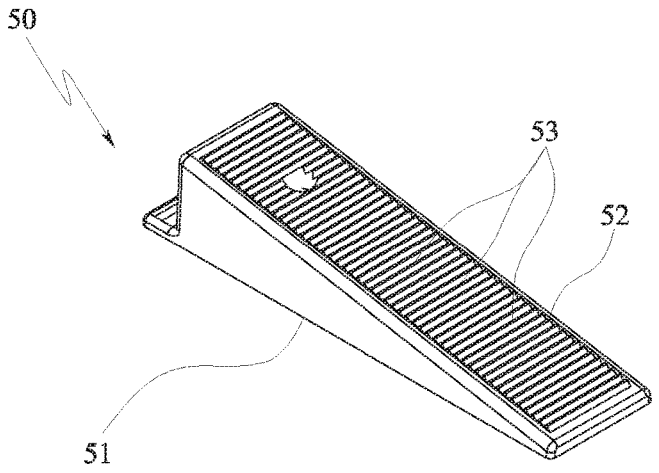
FIG. 9 is an axonometric view of a pressing wedge of a leveling spacer device, according to the invention.
Figure 10:
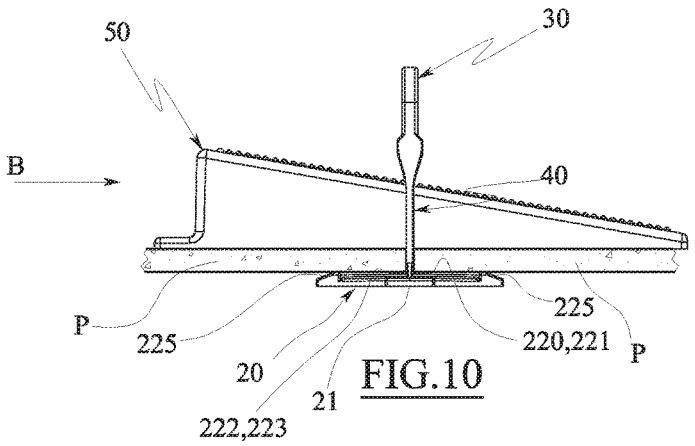
FIG. 10 is a side view of a leveling spacer device in operative configuration.

The device 10 also comprises a pressing wedge 50, separate from the base 20 and from the bridge 30 (see FIGS. 9 and 10).

The pressing wedge 50 is a rectangular wedge, for example it is equipped with a flat lower surface 51 and adapted for being arranged, in use, parallel to the support plane 221 of the central portion 220 of the upper surface 22 of the base 20 and an upper surface 52 inclined with respect to the lower surface 51 and equipped with abutment elements, such as teeth 53 or knurlings.

The pressing wedge 50 also comprises two parallel flanks.

The pressing wedge 50 has variable (and constantly increasing) thickness along its longitudinal axis from one end towards the opposite end.

The pressing wedge 50 is configured to be able to be slotted with clearance through the through opening 40 defined between the base 20 and the bridge 30 of the device 10 along a crossing direction B (see FIG. 10) that is perpendicular to the aforementioned mid-plane M of the bridge 30 and of the base 20.

For example, the maximum height of the pressing wedge 50 (maximum distance between its lower surface 51 and its upper surface 52) is less than the height of the through opening 40 defined by the distance between the cross-member 32 (i.e. its shaped edge) and the upper surface 22 of the base 20 (i.e. its support plane 221).

The shaped edge of the cross-member 32 is adapted for engaging the substantially pop-up teeth 53 during the translation inside the through opening 40 along the crossing direction B.

The width of the pressing wedge 50 is substantially equal to (or slightly less than) the distance between the two legs 31 (i.e. between the two facing edges thereof). The pressing wedge 50 is adapted for being slotted inside the through opening 40 and sliding, with the lower surface 51 resting on the visible surfaces of the tiles P resting on the support plane 211 defined by the upper surface 22 of the base 20, so that the upper surface 52 of the pressing wedge 50 goes into forced contact with the shaped edge of the cross-member 32 and the same pressing wedge 50 is thus pressed against both of the tiles P, arranged on opposite sides with respect to the bridge 30, to thrust them towards the base 20 and level them.

In light of what is described above, the operation of the device 10 is as follows.

Figure 11A:
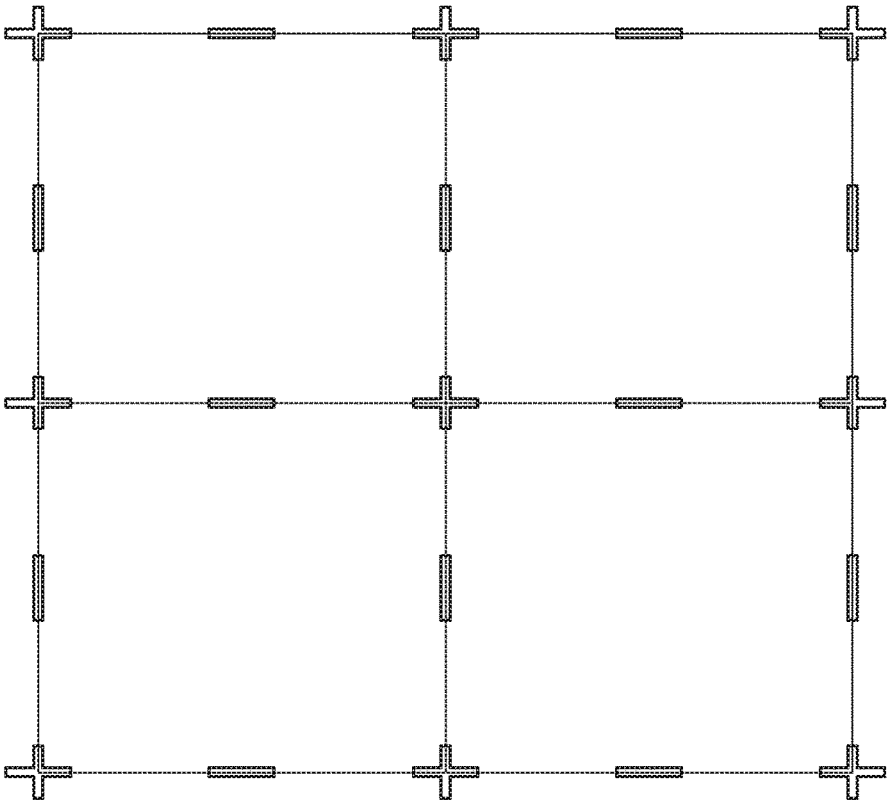
FIG. 11*a* is a schematic plan view of a first possible tile application scheme, called "stack bond".
Figure 11B:
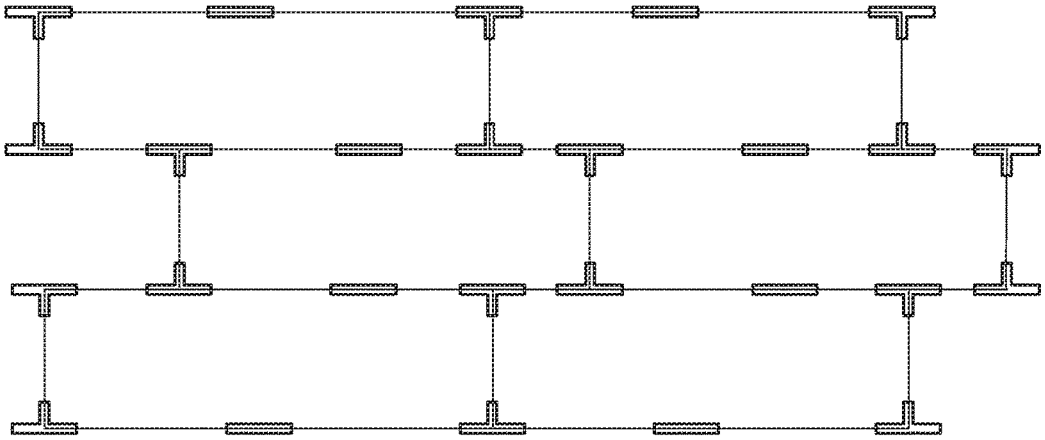
FIG. 11*b* is a schematic plan view of a second possible tile application scheme, called "offset".
Figure 11C:
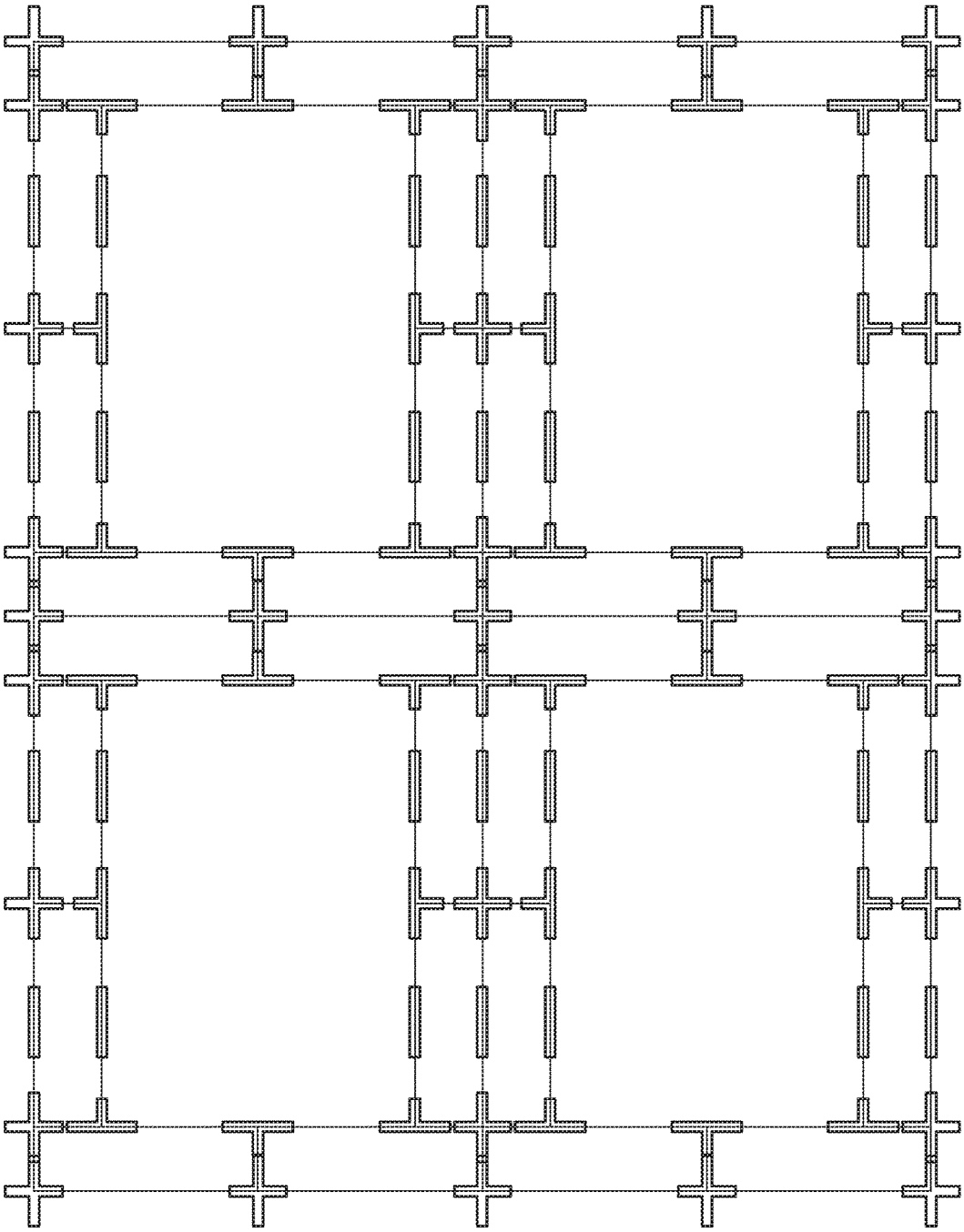
FIG. 11*c* is a schematic plan view of a third possible tile application scheme, called "complex".

The device 10 allows tiles P to be applied according to different application schemes as illustrated in FIGS. 11*a*-11*c*.

In order to coat a surface with a plurality of tiles P it is sufficient to apply a layer of glue on top and, then, it is possible to apply the tiles P on it.

In practice, where the first tile must be arranged it is sufficient to position a first device 10, the base 20 of which is intended, for example, to be arranged below four corners of respective two/four tiles P.

Once the base 20 has been positioned it is sufficient to position the two/four tiles P so that each of them has a portion of the sidewall in contact, respectively, with a flank 312 of one or both of the legs 31.

In this way, the equal spacing between the two/four tiles P that surround the bridge 30 is ensured and they rest on the support plane 221 of the base 20.

When for example the tiles P are particularly large in size, then it is possible to position a device 10 also at a middle area of the sidewall of the tile itself. In doing so, the tile P rests on one or more support planes 221 of respective bases 20.

Generally, firstly a tile P is applied and then a base portion 20 of the device 10 is inserted under it at the corner or at a sidewall thereof.

In this circumstance, the inclined surfaces 225 and the elongated shape in a direction perpendicular to the mid-plane M of the side portions 222 of the upper surface 22 (lowered with respect to the central portion 220) and, for example, the slots 23 play an important role in (jointly) facilitating the wedging of the base 20 under the surface of application of the tile P in any case allowing the glue not to be scraped entirely away from the application surface itself.

Once the various based 20 have been positioned with the respective bridges 30 that rise up above the visible surfaces of the adjacent tiles P as described above, as long as the glue is in any case still not entirely solidified the various pressing wedges 50 are inserted inside each through opening 40, which, by pressing on the visible surface of the tiles P, locally in the various (middle or corner) points, allow the perfect leveling of the visible surfaces of the tiles themselves.

Finally, when the glue has hardened and set, the long bridge 30 is broken causing, for example through an impulsive force directed parallel to the mid-plane M, the start of the fracture along fracture line 310 and the same bridge 30 (disposable) and the pressing wedge 50 (reusable) are thus removed to be able to putty the channels between the tiles P without the base 20 being visible on the finished surface and no part of the base 20 is arranged between the tiles themselves.

The invention thus conceived can undergo numerous modifications and variants all of which are covered by the inventive concept.

Moreover, all of the details can be replaced by other technically equivalent elements.

In practice, the materials used, as well as the contingent shapes and sizes, can be whatever according to requirements without for this reason departing from the scope of protection of the following claims.

The invention claimed is:

1. A tile-levelling spacer device comprising:

a base having a lower surface and an opposite upper surface, wherein the upper surface comprises:

a central portion defining a support plane for two adjacent tiles arranged at a fixed first distance from the lower surface and two opposite side portions with respect to the central portion and each defining a planar surface arranged at a second distance from the lower surface, wherein the second distance is shorter than the first distance;

a spacer bridge equipped with:

two legs rising from the base in a perpendicular direction with respect to at least the central portion of the upper surface of the base and a cross-member that joins the top of the two legs, wherein the cross-member has a first longitudinal axis arranged parallel to and distanced from the upper surface of the base;

a through opening perimetrically delimited by the cross-member and the legs of the bridge and by the upper surface of the base, wherein the through opening is suitable for being crossed by a pressing wedge along a crossing direction;

wherein each leg of the bridge is connected to the base at a respective side portion of the base in a breakable manner through a predetermined fracture line arranged at a third distance from the intermediate lower surface with respect to the first distance and to the second distance, wherein the support plane has a width, in a direction parallel to the first longitudinal axis of the cross-member, larger than a width, in the direction parallel to the first longitudinal axis of the cross-member, of each planar surface;

wherein each side portion has a second longitudinal axis parallel to the crossing direction of the pressing wedge and extends for the entire length of the base along such a crossing direction, and wherein the second distance is comprised between 20% and 90% of the first distance.

2. The device according to claim 1, wherein the second distance is comprised between 81% and 90% of the first distance.

3. The device according to claim 1, wherein the upper surface comprises a pair of opposite inclined surfaces at the ends of the base distal from the bridge and opposite with respect to it, wherein each inclined surface defines a ramp rising from the end of the base towards the bridge, in a direction parallel to the crossing direction, and which connects the lower surface of the base to the support plane of the central portion of the base.

4. The device according to claim 1, wherein the base comprises a pair of opposite through slots from the lower surface to the upper surface at the central portion thereof, wherein the slots are laterally open at the respective ends of the base distal from the bridge and opposite with respect to it.

5. The device according to claim 4, wherein each slot is adapted for intersecting a respective inclined surface dividing it into two separate portions along a direction perpendicular to the crossing direction.

6. The device according to claim 1, wherein the fracture line is defined by a longitudinal notch defining the area having a smaller section than the entire leg, wherein the longitudinal notch is parallel to the planar surface of the respective side portion of the upper surface of the base and perpendicular to the crossing direction, and wherein the longitudinal notch has a cross-section having a concave shape rounded according to a first radius of curvature.

7. The device according to claim 6, wherein the longitudinal notch is joined to the portion of the leg above it through a joining surface rounded according to a second radius of curvature, opposite and greater with respect to the first radius of curvature.

8. The device according to claim 6, wherein each leg comprises a central sector arranged between the cross-member and the lower end of the leg, wherein the central sector is equipped with two opposite flanks with respect to the crossing direction and parallel to one another, said flanks being adapted for making contact with the adjacent tiles resting on the central portion of the upper surface of the base defining the distance apart thereof, the central sector being connected to the respective side portion of the upper surface of the base by means of a block having a smaller cross-section than the distance between the two flanks of the central sector, wherein the upper end of the block is arranged at a fourth distance away from the lower surface of the base that is greater than the first distance.

9. The device according to claim 8, wherein the upper end of the block is joined to the central sector of the leg through a joining surface rounded according to a third radius of curvature, the same way as and greater than the first radius of curvature.

10. The device according to claim 1, wherein the upper surface of the base has a surface roughness comprised between 20VDI-30VDI.

11. The device according to claim 1, wherein the second distance is equal to 88% of the first distance.

12. The device according to claim 1, wherein the through opening is perimetrically delimited at the bottom by the support plane of the central portion of the upper surface.

13. The device according to claim 1, wherein the third distance is closer to the second distance than to the first distance.

14. The device according to claim 1, wherein the third distance is substantially equal to the second distance.

* * * * *